US008972247B2

(12) United States Patent
Margalit et al.

(10) Patent No.: US 8,972,247 B2
(45) Date of Patent: Mar. 3, 2015

(54) SELECTION OF SPEECH ENCODING SCHEME IN WIRELESS COMMUNICATION TERMINALS

(75) Inventors: Maor Margalit, Modiin (IL); David Ben-Eli, Modiin (IL); Paul S. Spencer, Modiin (IL)

(73) Assignee: Marvell World Trade Ltd., St. Michael (BB)

( * ) Notice: Subject to any disclaimer, the term of this patent is extended or adjusted under 35 U.S.C. 154(b) by 1408 days.

(21) Appl. No.: 12/337,706

(22) Filed: Dec. 18, 2008

(65) Prior Publication Data

US 2009/0171658 A1 Jul. 2, 2009

Related U.S. Application Data

(60) Provisional application No. 61/016,681, filed on Dec. 26, 2007.

(51) Int. Cl.

| | |
|---|---|
| ***G10L 19/00*** | (2013.01) |
| ***G10L 19/12*** | (2013.01) |
| ***G10L 21/00*** | (2013.01) |
| ***G10L 19/22*** | (2013.01) |

(52) U.S. Cl.

CPC ..... *G10L 19/22* (2013.01)
USPC ..... 704/201; 221/501; 221/E19.001

(58) Field of Classification Search

USPC ..... 704/201
See application file for complete search history.

(56) References Cited

U.S. PATENT DOCUMENTS

| | | | | |
|---|---|---|---|---|
| 6,163,577 | A * | 12/2000 | Ekudden et al. | 375/242 |
| 6,300,888 | B1 * | 10/2001 | Chen et al. | 341/63 |
| 6,529,730 | B1 * | 3/2003 | Komaili et al. | 455/452.2 |
| 7,277,849 | B2 * | 10/2007 | Streich et al. | 704/229 |
| 7,392,195 | B2 * | 6/2008 | Fejzo | 704/500 |
| 7,599,840 | B2 * | 10/2009 | Mehrotra et al. | 704/501 |
| 7,746,832 | B2 * | 6/2010 | Odenwalder | 370/335 |
| 7,804,802 | B2 * | 9/2010 | Stopler | 370/335 |
| 8,180,631 | B2 * | 5/2012 | Liebchen | 704/219 |
| 2003/0023534 | A1 * | 1/2003 | Kadambe | 705/36 |
| 2004/0179480 | A1 | 9/2004 | Attar et al. | |
| 2004/0199375 | A1 * | 10/2004 | Ehsani et al. | 704/4 |
| 2005/0018636 | A1 | 1/2005 | Paneth et al. | |
| 2005/0159919 | A1 * | 7/2005 | Sneddon | 702/179 |
| 2006/0182068 | A1 * | 8/2006 | Stopler | 370/335 |

(Continued)

FOREIGN PATENT DOCUMENTS

WO WO 2006068552 A1 * 6/2006

OTHER PUBLICATIONS

"3RD Generation Partnership Project; Technical Specification Group Services and System Aspects; Mandatory Speech CODEC Speech Processing Functions; AMR Speech CODEC; General Description (Release 6)", 3GPP TS 26.071 V6.0.0, Sophia Antipolis, France, Dec. 2004.

(Continued)

*Primary Examiner* — Richemond Dorvil
*Assistant Examiner* — Michael Ortiz Sanchez

(57) ABSTRACT

A method for communication includes receiving modulated signals, which convey encoded speech. A measure of information entropy associated with the received signals is estimated. A speech encoding scheme is selected responsively to the estimated measure of the information entropy. A request to encode subsequent speech using the selected speech encoding scheme is sent to a transmitter.

21 Claims, 2 Drawing Sheets

(56) References Cited

U.S. PATENT DOCUMENTS

| | | | | |
|---|---|---|---|---|
| 2006/0234642 | A1* | 10/2006 | Baum et al. | 455/67.13 |
| 2006/0251180 | A1* | 11/2006 | Baum et al. | 375/260 |
| 2006/0293885 | A1 | 12/2006 | Gournay et al. | |
| 2007/0242771 | A1 | 10/2007 | Kondo | |
| 2008/0198910 | A1* | 8/2008 | Tidestav | 375/226 |
| 2008/0215317 | A1* | 9/2008 | Fejzo | 704/217 |
| 2008/0260020 | A1* | 10/2008 | Pang et al. | 375/240 |
| 2008/0310322 | A1* | 12/2008 | Tidestav | 370/253 |
| 2009/0128410 | A1* | 5/2009 | Li | 342/367 |
| 2010/0064185 | A1* | 3/2010 | Zheng et al. | 714/704 |
| 2011/0302408 | A1* | 12/2011 | McDermott et al. | 713/153 |

OTHER PUBLICATIONS

"3RD Generation Partnership Project; Technical Specification Group GSM/Edge Radio Access Network; Link Adaption (Release 6)", 3GPP TS 45.009 V6.2.0, Sophia Antipolis, France, Jun. 2005.

International Application PCT/IL2008/001648 Search Report dated Mar. 26, 2009.

EP Application # 08864909.0 Search Report dated Nov. 2, 2011.

Chen et al., "The Application of EESM and MI-based Link Quality Models for Rate Compatible LDPC Codes", IEEE 66th Vehicular Technology Conference, pp. 1288-1292, Baltimore, UDS, Sep. 30-Oct. 3, 2007.

3GPP TS45.009, 3rd Generation Partnership Project; Technical Specification Group GSM/EDGE Radio Access Network; Link Adaptation (release 7), v.7.0.0., Aug. 2007.

Bruhn et al., "Concepts and Solutions for Link Adaptation and Inband Signaling for the GSM AMR Speech Coding Standard", IEEE Vehicular Technology Conference, vol. 3, pp. 2451-2455, Houston, USA, May 16-20, 1999.

Chinese Patent Application # 200880123204.7 Office Action dated Nov. 5, 2012.

* cited by examiner

SELECTION OF SPEECH ENCODING SCHEME IN WIRELESS COMMUNICATION TERMINALS

CROSS-REFERENCE TO RELATED APPLICATIONS

This application claims the benefit of U.S. Provisional Patent Application 61/016,681, filed Dec. 26, 2007, whose disclosure is incorporated herein by reference.

FIELD OF THE INVENTION

The present invention relates generally to communication systems, and particularly to methods and systems for encoding speech in wireless communication systems.

BACKGROUND OF THE INVENTION

Many communication systems provide speech communication services, i.e., convey speech between users. The conveyed speech is often compressed using a suitable speech encoding scheme before it is transmitted. Some communication protocols deploy multiple different speech encoding schemes. For example, the Global System for Mobile communications (GSM) standards, the Universal Mobile Telecommunications Service (UMTS) standards and the GSM EDGE Radio Access network (GERAN) standards use a set of speech encoding schemes referred to as Adaptive Multi-Rate (AMR). AMR is defined, for example, in 3$^{rd}$ Generation Partnership Project (3GPP) Technical Specification 26.071, entitled "Technical Specification Group Services and System Aspects; Mandatory Speech CODEC Speech Processing Functions; AMR Speech CODEC; General Description (Release 6)," (3GPP TS 26.071), version 6.0.0., December, 2004, and in 3GPP Technical Specification 45.009, entitled "Technical Specification Group GSM/EDGE Radio Access Network; Link Adaptation (Release 6)," (3GPP TS 45.009), version 6.2.0, June, 2005, which are incorporated herein by reference.

In some communication protocols, the appropriate speech encoding scheme is selected based on the channel conditions between the transmitter and the receiver. For example, section 3.3.1 of 3GPP TS 45.009, cited above, proposes the use of Carrier to Interference Ratio (CIR) as a criterion for selecting an appropriate AMR encoding scheme.

SUMMARY OF THE INVENTION

An embodiment of the present invention provides a method for communication, including:

- receiving modulated signals, which convey encoded speech;
- estimating a measure of information entropy associated with the received signals;
- selecting a speech encoding scheme responsively to the estimated measure of the information entropy; and
- sending a request to a transmitter to encode subsequent speech using the selected speech encoding scheme.

In an embodiment, estimating the measure of the information entropy includes estimating a Mutual Information (MI) of the received signals. Alternatively, estimating the measure of the information entropy includes estimating an Exponential Effective Signal to Interference and Noise Ratio Mapping (EESM) function, calculated over the received signals.

In some embodiments, receiving the modulated signals includes receiving a sequence of modulated symbols that are divided into multiple groups, and estimating the measure of the information entropy includes estimating multiple measures of the information entropy over the respective groups. Receiving the sequence may include receiving the multiple groups of the symbols over respective, different time slots. In a disclosed embodiment, estimating the measures of the information entropy includes calculating Signal to Noise Ratios (SNRs) of the symbols in the respective groups, and computing the measures of the information entropy responsively to the respective SNRs.

Selecting the speech encoding scheme may include averaging the measures of the information entropy, and selecting the speech encoding scheme responsively to the averaged measures of the information entropy. In an embodiment, selecting the speech encoding scheme includes computing an equivalent Carrier to Interference (C/I) ratio responsively to the averaged measures of the information entropy, and selecting the speech encoding scheme responsively to the equivalent C/I ratio. In another embodiment, selecting the speech encoding scheme includes computing an estimated Frame Error Rate (FER) responsively to the averaged measures of the information entropy, and selecting the speech encoding scheme responsively to the estimate FER.

In some embodiments, estimating the measure of the information entropy includes estimating a Frame Error Rate (FER) of the received signals responsively to the measure of the information entropy, and selecting the speech encoding scheme includes predefining a target FER value, and selecting the speech encoding scheme such that the estimated FER of the received signals meets the target FER value.

There is additionally provided, in accordance with an embodiment of the present invention, a communication apparatus, including:

- a transceiver, which is configured to receive modulated signals that convey encoded speech; and
- a processor, which is configured to estimate a measure of information entropy associated with the received signals, to select a speech encoding scheme responsively to the estimated measure of the information entropy, and to send via the transceiver a request to a transmitter to encode subsequent speech using the selected encoding scheme.

There is further provided, in accordance with an embodiment of the present invention, a method for communication, including:

- receiving modulated signals, which convey encoded speech;
- estimating a measure of information entropy associated with the received signals;
- estimating a block error rate of the received signals responsively to the estimated measure of the information entropy; and
- selecting a speech encoding scheme responsively to the estimated block error rate.

The present invention will be more fully understood from the following detailed description of the embodiments thereof, taken together with the drawings in which:

DETAILED DESCRIPTION OF EMBODIMENTS

Figure 1:
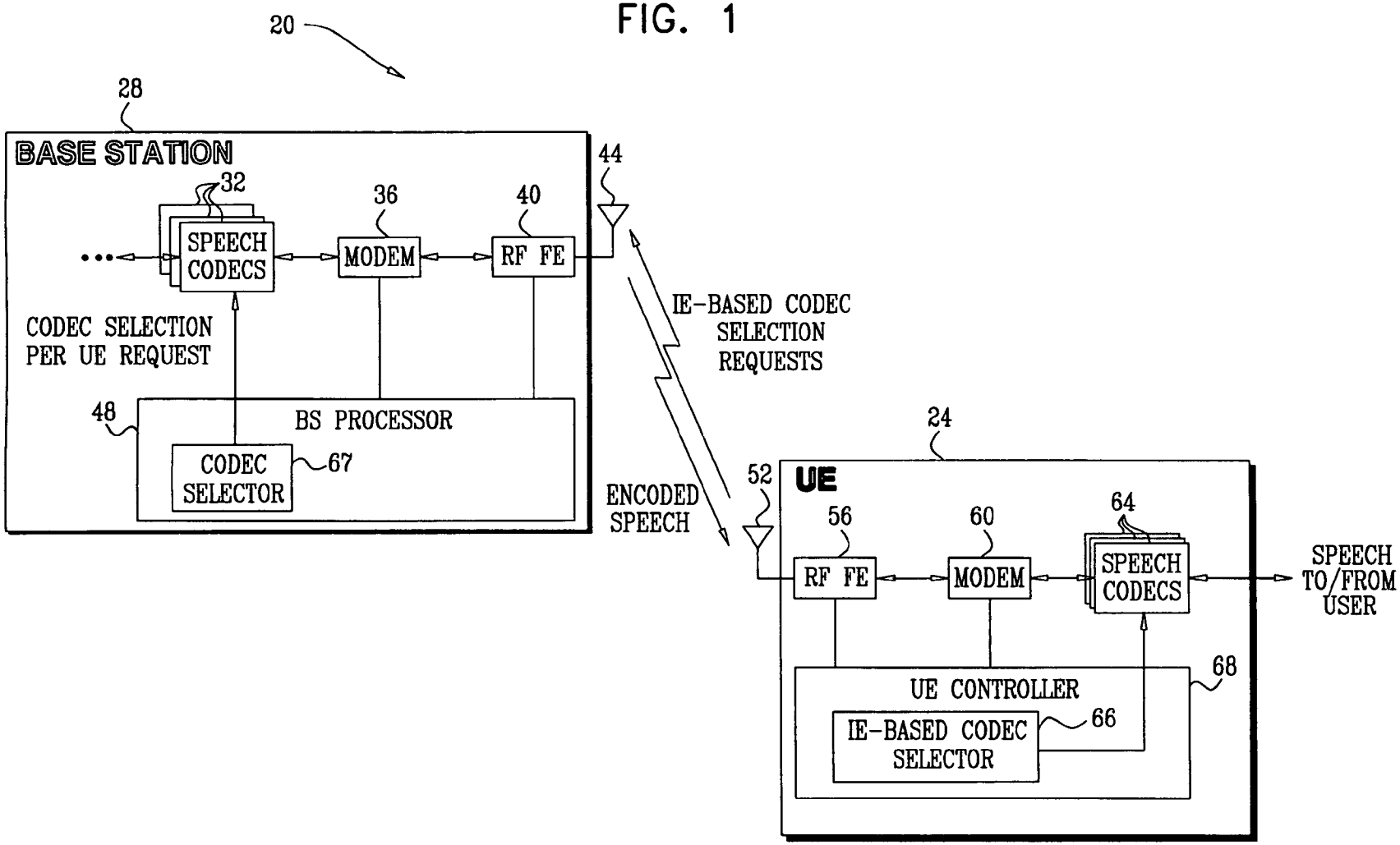
FIG. 1 is a block diagram that schematically illustrates a wireless communication system, in accordance with an embodiment of the present invention.

Some speech communication systems employ a set of multiple speech encoding schemes, and select the appropriate scheme to be used between a transmitter and a receiver based on channel conditions. Each speech encoding scheme is characterized by a certain output data rate, and provides a certain trade-off between voice quality and communication robustness. Selecting a lower data rate speech encoding scheme enables improved channel coding, and therefore improves communication robustness at the expense of voice quality, and vice versa. For example, full-rate AMR schemes in GERAN have output data rates ranging between 12.2 Kbps for good channel conditions and 4.75 Kbps for poor channel conditions.

Conventionally, the desired speech encoding scheme may be selected based on the Signal-to-Noise Ratio (SNR) or Carrier-to-Interference Ratio (CIR) measured by the receiver. These criteria, however, do not always reflect the actual voice quality experienced by the user. For example, the voice quality at a given SNR or CIR may vary considerably depending on various propagation characteristics of the communication channel, such as multipath level or delay spread.

The speech encoding process typically produces a sequence of speech frames. Another possible criterion for selecting a speech encoding scheme, which usually provides a better indication of voice quality, is the Frame Error Rate (FER) in the speech frames received by the receiver. However, conventionally, reliable FER measurement typically involves measuring an error rate of the speech frames over a large number of speech frames. Since in many applications the channel conditions vary rapidly over time, measurement of FER for numerous frames is often too slow to adapt to varying channel conditions. Moreover, direct FER measurements usually depend on the specific format of the transmitted speech frames and may not be suitable.

Embodiments of the present invention that are described hereinbelow provide improved methods and systems for selecting the appropriate speech encoding scheme to be used for conveying speech from a transmitter to a receiver. The methods and systems described herein do not measure the FER directly, but rather compute measures of information entropy, which are well representative of the FER even when they are measured and averaged over short time intervals. The computed measures of information entropy can be readily applied to generate a CIR value. It is noted that in accordance with some cellular telecommunications standards, speech encoding schemes are selected based on CIR. Several examples of information entropy measures are described herein, such as Mutual Information (MI) and Exponential Effective Signal to Interference and Noise Ratio Mapping (EESM).

In accordance with an embodiment, a transceiver receives modulated signals, which convey encoded speech. The transceiver estimates a measure of information entropy that is associated with the received signals, and selects the appropriate speech encoding scheme based on the estimated information entropy measure. In an embodiment, a CIR value is calculated based on the estimated information entropy measure. Additionally or alternatively, a Block Error Rate (BLER) or FER of the signal is estimated based on the estimated information entropy measure. In some embodiments, the transceiver sends to a transmitter a request to encode subsequent speech using the selected speech encoding scheme.

The methods described herein enable the transceiver to select the appropriate speech encoding scheme based on a criterion that closely follows the actual FER, irrespective of channel propagation characteristics. Communication systems that use these methods are able to adapt their speech coding and channel coding configurations to rapidly varying channel conditions, while maintaining the desired voice quality and user experience.

FIG. 1 is a block diagram that schematically illustrates a wireless communication system 20, in accordance with an embodiment of the present invention. In system 20, a wireless communication terminal 24 (also referred to as a User Equipment—UE) communicates with a Base Station (BS) 28 over a wireless channel. System 20 may conform to any suitable communication standard or protocol. For example, the system may comprise a cellular communication system such as a Global System for Mobile communications (GSM), Universal Mobile Telecommunications Service (UMTS) or GSM EDGE Radio Access network (GERAN) system. Although the description that follows refers to a single BS and a single UE for the sake of clarity, system 20 typically comprises multiple BSs and multiple UEs.

Speech that is to be transmitted from BS 28 to UE 24 is provided to a BS speech encoder/decoder (codec) 32, which encodes the speech using a certain speech encoding scheme that is selected from a set of possible encoding schemes. Each encoding scheme in the set is characterized by a certain output data rate. For example, codec 32 may apply one of the full-rate AMR schemes cited above, whose data rates range between 4.75 and 12.2 Kbps. Typically, codec 32 produces a sequence of speech frames comprising the encoded speech.

In the example of FIG. 1, BS 28 is shown as having multiple CODECs 32, one of which is selected to encode given speech. In many practical cases, however, the BS comprises a single speech CODEC that can be configured to apply the selected scheme. In some embodiments, the CODEC may apply the same encoding in different encoding schemes, and the schemes may differ from one another in the way different information is quantized after the speech has been encoded. For example, key parameters may be sent using six-bit quantization in one speech encoding scheme, and at three-bit quantization in another scheme.

The speech frames are provided to a BS modulator/demodulator (modem) 36, which modulates the encoded speech to produce a sequence of modulated symbols. In some embodiments, modem 36 comprises an Error Correction Code (ECC) encoder (not shown in the figure), which applies channel coding to the encoded speech. The output of modem 36 conforms to the formats defined in the communication protocol of system 20. For example, in a GSM or GERAN system, each channel is divided into frames that are further divided into time slots, and the modulated symbols destined to a given UE occupy a particular time slot of each frame.

The output of modem 36 is provided to a BS Radio Frequency Front End (RF FE) 40, which typically converts the digital modem output to an analog signal using a suitable Digital to Analog Converter (DAC), up-converts the analog signal to RF and amplifies the RF signal to the appropriate transmission power. The RF FE may also perform functions such as filtering and power control, as are known in the art. The RF signal at the output of RF FE 40 is transmitted via a BS antenna 44 toward UE 24.

BS 28 further comprises a BS processor, which configures and controls the different elements of the BS. In particular, processor 48 instructs speech codec 32 to select a given speech encoding scheme, as will be explained in greater detail below.

The RF signal transmitted from the BS is received at the UE by a UE antenna 52, and is provided to a UE RF FE 56. RF FE 56 down-converts the received RF signal to a suitable low frequency (e.g., to baseband), and digitizes the signal using a suitable Analog to Digital Converter (ADC). The digitized signal is provided to a UE modem 60, which demodulates the signal and attempts to reconstruct the speech frames that were provided to BS modem 36 at the BS. In some embodiments, the UE modem comprises an ECC decoder (not shown in the figure), which decodes the channel code applied by the BS. The reconstructed speech frames are provided to a UE speech codec 64, which decodes the encoded speech conveyed in each frame. The decoded speech is then converted to audio and output to the user.

UE 24 further comprises a UE controller 68, which configures and controls the different elements of the UE. In particular, controller 68 selects, using methods that are described hereinbelow, the appropriate speech encoding scheme that is to be used by BS 28 for transmitting subsequent speech to the UE.

As will be explained in detail below, the UE selects an appropriate speech encoding scheme that is to be applied by the BS for encoding subsequent speech. The UE selects the appropriate speech encoding scheme by computing measures of Information Entropy (IE) associated with the signals received from the BS. The UE sends a request to the BS, requesting the BS to encode subsequent speech using the selected scheme. In some embodiments, UE controller 68 comprises a UE CODEC selector 66, which computes the IE measures and selects the desired speech encoding scheme. BS processor 48 comprises a BS CODEC selector 67, which controls speech CODECs 32 to apply the encoding scheme requested by the UE.

The description above refers to downlink transmission, i.e., transmission from the BS to the UE. On uplink transmission, the different elements of the UE and BS typically perform the opposite functions. In other words, UE codec 64 encodes the uplink speech to produce uplink speech frames, and UE modem 60 modulates and formats the uplink signal, and applies channel coding. UE RF FE up-converts the signal to RF and transmits the signal toward the BS via UE antenna 52. The uplink RF signal is received by BS antenna 44, down-converted by BS RF FE 40, and demodulated by BS modem 36, which also decodes the ECC. BS codec 32 decodes the uplink speech frames to reconstruct the speech that was provided to codec 64 at the UE.

The embodiments described herein mainly address speech encoding scheme selection in the downlink. In these embodiments, UE controller 68 selects the appropriate speech encoding scheme to be employed in the downlink, based on measurements performed by UE modem 60 on the received downlink signal. The UE controller then sends a request to the BS (over the uplink), requesting the BS to encode subsequent downlink speech using the selected scheme. In alternative embodiments, however, the methods and systems described herein can be used in the uplink. In such alternative embodiments, the BS processor selects the appropriate speech encoding scheme for the uplink, based on measurements performed by BS modem 36 on the received uplink signal. The BS processor then instructs the UE controller to apply the selected scheme when transmitting subsequent uplink speech.

Typically, BS processor 48 and UE controller 68 comprises general-purpose processors, which are programmed in software to carry out the functions described herein. The software may be downloaded to the processors in electronic form, over a network, for example, or it may, alternatively or additionally, be provided and/or stored on tangible media, such as magnetic, optical, or electronic memory.

The configuration of UE 24 and BS 28 is an example configuration, which was chosen purely for the sake of conceptual clarity. In alternative embodiments, any other suitable UE and BS configurations can be used.

Embodiments of the present invention provide improved methods and systems for selecting a speech encoding scheme, to be used for conveying speech from BS 28 to UE 24. In the description that follows, system 20 comprises a GERAN system that uses AMR speech coding. The downlink transmission of the BS comprises a sequence of time frames, each divided into eight time slots. The time slots are also referred to as bursts. The speech that is destined to a given UE is transmitted over multiple time frames, at a particular burst within each time frame. Typically, a given encoded speech frame is transmitted in four or eight bursts. In some embodiments, the BS applies frequency hopping, such that different time frames are transmitted over different frequencies.

In most practical cases, the voice quality experienced by a user of UE 24 is correlative with the Frame Error Rate (FER) in the speech frames that are provided to UE speech codec 64. (Speech frames are sometimes referred to herein as speech blocks, and the terms FER and Block Error Rate (BLER) are used herein interchangeably.) Therefore, it is desirable to select the speech encoding scheme using a criterion that follows the FER of the speech frames.

It is possible in principle for UE controller 68 to estimate the FER by measuring the Signal-to-Noise Ratio (SNR) or Carrier-to-Interference Ratio (CIR) of the received signal in each burst, and then averaging the SNRs over several bursts. This sort of estimate based on SNR averaging, however, is often inaccurate, since the relationship between FER and SNR is usually far from linear. Typically, the FER is zero, or near zero, for a wide range of high SNR values. However, as the SNR deteriorates beyond a certain threshold value, the FER increases steeply over a narrow range of SNR values. (Note that the terms SNR and CIR are sometimes used interchangeably herein. Both terms are used generally, and refer to various other ratios of a desired signal to undesired noise, distortion and/or interference.)

Consider, for example, a sequence of speech frames, most of which are received at a very high SNR, with only one or two frames received at a marginal SNR. In such a scenario, the FER of this frame sequence is dominated by the small subset of frames having the marginal SNR. However, measuring the SNR of each burst and then averaging the burst-level SNRs will produce an unrealistically good (low) estimate of the FER, since the large number of high burst-level SNRs will dominate the average SNR. In reality, the actual average FER of this frame sequence is considerably higher than anticipated by the above-mentioned estimate.

In accordance with the methods described herein, UE controller 68 does not average raw SNR or CIR measurements. Instead, the UE controller computes a measure of information entropy for each received burst, and then averages the information entropy measures. Information entropy typically exhibits a non-linear dependence on SNR, which resembles the FER/SNR dependence. As such, averaging information entropy measures produces an estimate that closely follows the actual FER and is not dominated by exceedingly high SNRs. A similar argument holds for low SNRs, i.e., an estimate that is based on averaged information entropy measures will not be dominated by exceedingly low SNRs.

Information entropy, denoted H(X), is a well-known concept in information theory, which quantifies the amount of uncertainty associated with a random variable X. In communication systems, the information entropy of a received signal quantifies the amount of information content that is missed by not knowing a-priori the exact value of the transmitted signal. Put in another way, the information entropy of a received signal is indicative of the number of information bits that an optimal receiver would be able to decode from the signal.

Unlike measures such as CIR and SNR, which quantify the amount of noise or distortion that affect the received signal, information entropy measures quantify the amount of information that is potentially extractable from the received signal. Noise and distortion measures such as CIR and SNR are usually linearly dependent on the level of the noise or distortion. Information entropy measures, on the other hand, are typically not linearly dependant on the noise or distortion level.

The distinct difference between SNR/CIR measures and information entropy measures can be demonstrated using two example scenarios. Consider, for example, a scenario in which the SNR/CIR of a given received signal increases by a large amount, from a high value to a very high value. Since the number of bits that are potentially extractable from the signal was already high in the first place, the increase in SNR/CIR will cause only a small increase in any information entropy measure of the signal. On the other hand, consider a scenario in which the SNR/CIR increases by the same amount, but from a low value to a high value. In the latter scenario, the number of information bits that can be potentially extracted from the signal increases considerably. As such, any information entropy measure of the signal will increase considerably.

The Mutual Information (MI) quantifies the amount of dependence of a received signal Y on a transmitted signal X, and is defined as $$I(X, Y) = \sum_{y \in Y} \sum_{x \in X} p(x, y) \log\left(\frac{p(x, y)}{p_1(x) p_2(y)}\right) \quad \text{Equation 1}$$

wherein p(x,y) denotes the joint probability distribution of X and Y. $p_1(x)$ and $p_2(Y)$ denote the marginal probability distributions of X and Y, respectively.

In some embodiments, UE controller 68 estimates the MI of the transmitted and received signal in each burst, and uses the estimated MI values as information entropy measures. The UE controller averages the MI values over multiple bursts, to produce an estimate of the FER. The FER estimate is then used as a criterion for selecting the appropriate speech encoding scheme. In accordance with an embodiment the FER estimate may be expressed as a CIR value.

In some embodiments, the UE processor holds a pre-calculated mapping of MI values to SNR values. The UE processor accepts SNR measurements corresponding to the different bursts from UE modem 60, and determines the MI of each burst by applying the pre-calculated mapping to the measured SNR of the burst. The mapping may be represented in various ways, such as using a look-up table of MI values, using a functional representation, or any other suitable representation. The relationship between MI and SNR depends on the particular modulation that is used for transmitting the signal. Thus, the mapping used by controller 68 depends on the modulation used in the downlink.

Figure 2:
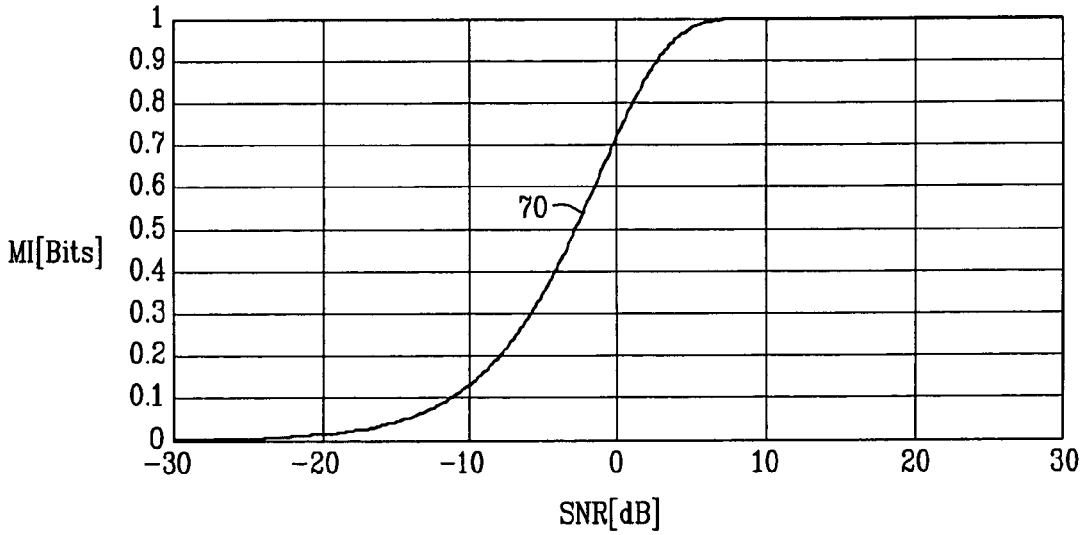
FIG. 2 is a graph showing Mutual Information (MI) as a function of Signal-to-Noise Ratio (SNR), in accordance with an embodiment of the present invention.

FIG. 2 is a graph showing Mutual Information (MI) as a function of Signal-to-Noise Ratio (SNR), in accordance with an embodiment of the present invention. In the present example, a curve 70 shows the dependence of MI on SNR for Gaussian Minimum Shift Keying (GMSK) or Binary Phase Shift Keying (BPSK) modulation and an Additive White Gaussian Noise (AWGN) communication channel. As seen in the figure, the dependence of MI on SNR is far from linear, and is much like the dependence of FER on SNR. Curve 70 reaches saturation at approximately SNR=7 dB. Therefore, when averaging MI values, exceedingly high and/or exceedingly low SNR values cannot dominate the average MI. As a result, estimating the MI in each burst, and then averaging the estimated MI values, produces an estimate that closely follows the actual achievable error performance, i.e., the FER, and is not skewed by high or low SNRs.

Figure 3:
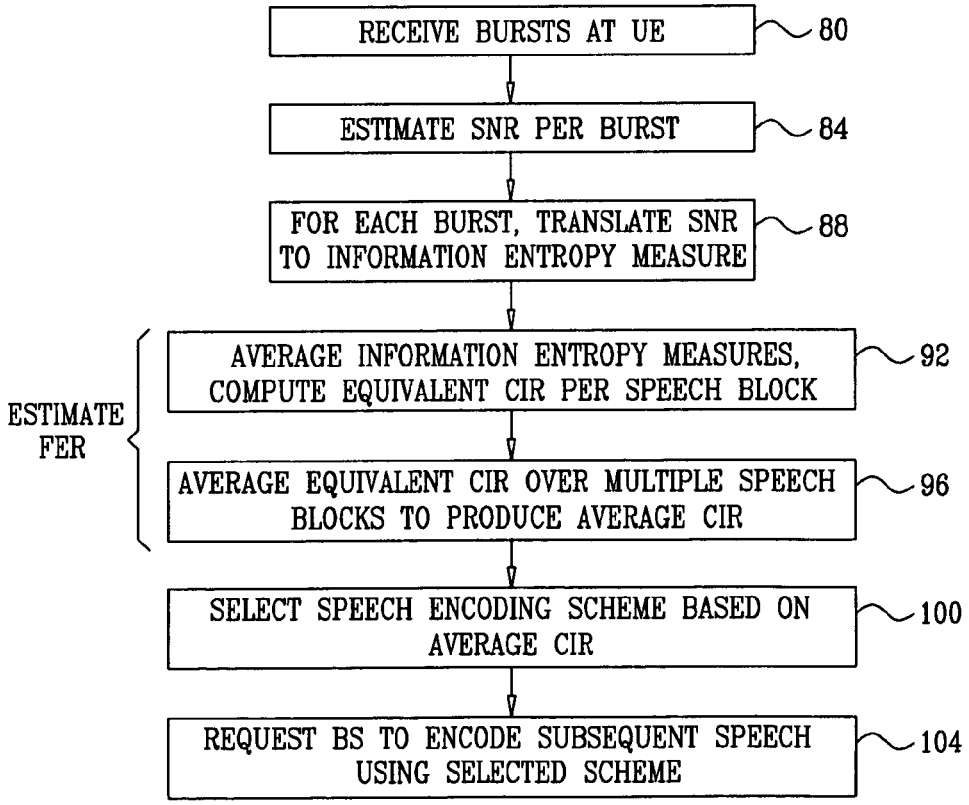
FIG. 3 is a flow chart that schematically illustrates a method for selecting a speech encoding scheme, in accordance with an embodiment of the present invention.

FIG. 3 is a flow chart that schematically illustrates a method for selecting a speech encoding scheme, in accordance with an embodiment of the present invention. The method is described in the context of cellular telecommunications that are compliant with GSM standards and begins with UE 24 receiving a signal which conveys encoded speech, at a reception step 80. In accordance with an embodiment, the signal is transmitted as a sequence of bursts. Each burst originates from a certain GERAN time slot that is destined to the UE in question. The bursts are received by RF FE 56 and demodulated by modem 60. Modem 60 estimates the SNR (or CIR) in each burst, at a burst SNR estimation step 84. The modem provides the burst SNR values to UE controller 68.

The modem can estimate the burst SNRs in any suitable way. For example, in some systems each burst contains a known training sequence (e.g., a preamble). The modem may subtract the training sequence that was received in a given burst from the known training sequence, and estimate the SNR based on the difference between the received and known sequences (e.g., by calculating the noise variance).

Alternatively, the modem may measure the Bit Error Probability (BEP) in a given burst, and then translate the measured BEP into an estimated SNR, e.g., using a predefined mapping between the two quantities. For example, for BPSK modulation and a memoryless AWGN channel, it can be shown that the BEP can be written as $$\text{BEP} = Q(\sqrt{2\text{SNR}}) \quad \text{Equation 2}$$

Further alternatively, the modem may calculate an average Log Likelihood Ratio (LLR) or $\text{LLR}^2$ over the burst, and translate this value into an estimated SNR, such as using a predefined mapping between the two quantities. For example, for BPSK modulation and a memoryless AWGN channel, it can be shown that the relation between LLR and SNR can be written as $$SNR \approx \frac{\sqrt{1 + E(LLR^2)} - 1}{4} \quad \text{Equation 3}$$

wherein $E(\text{LLR}^2)$ denotes the mean value of $\text{LLR}^2$.

For each burst, the UE controller translates the burst SNR to a respective entropy measure (e.g., a MI value), at a translation step 88. The UE controller estimates the FER of the downlink speech frames based on the entropy measures of the received bursts. In some embodiments, controller 68 averages the set of entropy measures pertaining to a given speech block (speech frame), to produce an equivalent CIR value of the speech block, at an equivalent CIR calculation step 92. Note that the equivalent CIR is not dominated by bursts having high or low SNR values, since it is computed by averaging entropy measures rather than SNR measurements.

In some embodiments, the equivalent CIR can be defined as the CIR value that would be required to reach the desired FER in an AWGN channel. In other words, the equivalent CIR is substantially agnostic to the type of channel (e.g., to the channel propagation characteristics). Alternatively, the equivalent CIR can be defined as the CIR value that would be required to reach the desired FER in any other predefined reference channel model, such as a Typical Urban channel assuming frequency hopping and a 3 Km/h UE velocity. This reference channel model is referred to as TU3 in GSM terminology.

The UE controller repeats step 92 for different speech blocks, so as to produce multiple equivalent CIR values, one value corresponding to each speech block. The UE controller then averages the equivalent CIR values over multiple speech blocks, at a CIR averaging step 96. The output of step 96 is an average CIR, which was derived by averaging the information entropy measures.

The UE controller now selects a speech encoding scheme from a set of possible encoding schemes based on the average CIR value, at a selection step 100. Typically, a high average CIR value will correspond to a high rate speech encoding scheme, and vice versa.

In some embodiments, the UE controller divides the overall range of average CIR values into multiple intervals corresponding to the different possible speech encoding schemes. The UE controller selects the speech encoding scheme that corresponds to the interval in which the average CIR, which was calculated at step 100 above, falls. Alternatively, the UE controller may hold a functional relationship, or any other sort of mapping, that maps average CIR values to speech encoding schemes.

Having selected the desired speech encoding scheme, the UE sends a request message to the BS over the uplink, at a requesting step 104. The message requests the BS to use the speech encoding scheme selected at step 100 above for transmitting subsequent speech to the UE. The request is typically processed by BS processor 48, which configures BS speech codec 32 to apply the selected encoding scheme.

In an alternative embodiment, the UE controller does not necessarily calculate an equivalent CIR value per each speech block. For example, the UE controller may average the information entropy measures over multiple bursts, and then compute an estimate of the FER based on the average information entropy measure. The FER estimate can then be averaged over multiple speech blocks to produce the average CIR. Further alternatively, the UE controller may apply any other suitable computation for selecting the appropriate speech encoding scheme based on the averaged information entropy measures.

In some communication systems, the bursts belonging to a given speech block are distributed over B time frames, using diagonal interleaving. When using diagonal interleaving, a new speech block is available every C time frames. For example, in GERAN systems that use full-rate AMR speech coding, B=8 and C=4. When implementing the disclosed methods in such a system, the UE controller may store the last N measured burst SNR values in a table having the following structure:

| | 1 | 2 | 3 | 4 | 5 | 6 | 7 | 8 |
|---|---|---|---|---|---|---|---|---|
| Speech block 1 | SNR i | SNR i – 1 | SNR i – 2 | SNR i – 3 | SNR i – 4 | SNR i – 5 | SNR i – 6 | SNR i – 7 |
| Speech block 2 | SNR i – 4 | SNR i – 5 | SNR i – 6 | SNR i – 7 | SNR i – 8 | SNR i – 9 | SNR i – 10 | SNR i – 11 |
| Speech block 3 | SNR i – 8 | SNR i – 9 | SNR i – 10 | SNR i – 11 | SNR i – 12 | SNR i – 13 | SNR i – 14 | SNR i – 15 |
| Speech block 4 | SNR i – 12 | SNR i – 13 | SNR i – 14 | SNR i – 15 | SNR i – 16 | SNR i – 17 | SNR i – 18 | SNR i – 19 |

In the present example, the UE controller stores the last N=20 burst SNRs in an interleaved manner. In the array, SNR i denotes the most recently measured burst SNR, SNR i–1 denotes the previous burst SNR, and so on. Each row of the array corresponds to a certain speech block. Typically, the array is populated in a cyclic manner, such that a newly-measured burst SNR overwrites the oldest SNR in the array.

Using this data structure, the UE controller carries out steps 92 and 96 of the method of FIG. 3 by (1) translating the B burst SNRs in a given row of the array into respective information entropy measures, (2) averaging the information entropy measures in each row, and then (3) averaging the averaged information entropy measures over multiple rows.

Alternatively to using Mutual Information (MI), the UE controller may evaluate an Exponential Effective Signal to Interference and Noise Ratio Mapping (EESM) function for each burst, and use these values as information entropy measures. The EESM function can be viewed as an approximation of MI, and can be written as $$\mathrm{EESM}(\mathrm{SNR}) \approx 1 - e^{-SNR}/\beta \qquad \text{Equation 4}$$

wherein β denotes a parameter. Different values of β cause the EESM function to approximate the MI function with greater accuracy under different working conditions.

For example, when using BPSK modulation, β values in the range of 0.7-0.75 are typically preferable (i.e., provide a better approximation of the MI function) for AMR speech encoding schemes having low data rates. For AMR speech encoding schemes having high data rates, β values in the range of 0.8-0.85 are typically preferred. For an encoding scheme having a code rate of 0.5, β values in the range of 0.75-0.8 may be produce better results. Alternatively, any other suitable setting of β can also be used.

When using EESM, the equivalent SNR of a given speech block (substituting the equivalent CIR calculated at step 92 of the method of FIG. 3) can be written as $$\mathrm{SNR}_{EQ} = \mathrm{EESM}^{-1}\{\mathrm{mean}(\mathrm{EESM}(\mathrm{SNR}(\mathrm{burst}_i))\} \qquad \text{Equation 5}$$

In other words, the UE controller calculates the EESM of the different bursts based on the estimated burst SNRs, averages the EESMs, and then applies an inverse EESM function to produce the equivalent SNR. This operation can be viewed as transforming the estimated SNRs onto the EESM plane, averaging in the EESM plane, and then transforming the result back to the SNR plane.

Using the above-mentioned definition of EESM, the equivalent block SNR can be written as $$SNR_{EQ} = -\beta \cdot \ln\left[\text{mean}\left(e^{-\frac{SNR}{\beta}}\right)\right] \quad \text{Equation 6}$$

The embodiments described above refer to the use of MI and EESM as information entropy measures. In alternative embodiments, however, any other suitable information entropy measure, such as measures based on estimated capacity, can be used. The embodiments described herein mainly address entropy measures that correspond to different time slots of bursts. Alternatively, however, the UE controller may compute entropy measures corresponding to any other suitable groups of bits that are destined to the UE in question. As such, the methods described herein are in no way limited to communication systems that differentiate between UEs using Time-Division Multiple Access (TDMA), and can be used in other kinds of systems, such as Frequency-Division Multiple Access (FDMA) systems that transmit to different UEs over different frequencies, and Code-Division Multiple Access (CDMA) systems that transmit to different UEs using different code sequences.

When using the disclosed methods, the appropriate speech encoding scheme is selected using a criterion that is closely correlative with the FER of the speech frames. For example, the UE controller can select the speech encoding scheme so that the FER remains in the vicinity of a desired target value (e.g., 1%), regardless of channel conditions and propagation characteristics. As such, the voice quality experienced by the user remains substantially constant at the desired level. Since the information entropy measures provide a reliable indication of FER even when averaged over short periods, the disclosed methods are well suited for communication channels whose propagation characteristics change rapidly over time.

It is noted that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art.

The invention claimed is:

1. A method for communication, comprising:

receiving modulated signals, which convey encoded speech that is encoded using a first speech encoding scheme;

estimating a measure of information entropy, which quantifies an amount of information content in the encoded speech that is missed by not having a prior knowledge of transmitted values of the received signals;

selecting a second speech encoding scheme, different from the first speech encoding scheme, responsively to the estimated measure of the information entropy; and sending a request to a transmitter to encode subsequent speech using the selected second speech encoding scheme.

2. The method according to claim 1, wherein estimating the measure of the information entropy comprises estimating a Mutual Information (MI) of the received signals.

3. The method according to claim 1, wherein estimating the measure of the information entropy comprises estimating an Exponential Effective Signal to Interference and Noise Ratio Mapping (EESM) function, calculated over the received signals.

4. The method according to claim 1, wherein receiving the modulated signals comprises receiving a sequence of modulated symbols that are divided into multiple groups, and wherein estimating the measure of the information entropy comprises estimating multiple measures of the information entropy over the respective groups.

5. The method according to claim 4, wherein receiving the sequence comprises receiving the multiple groups of the symbols over respective, different time slots.

6. The method according to claim 4, wherein estimating the measures of the information entropy comprises calculating Signal to Noise Ratios (SNRs) of the symbols in the respective groups, and computing the measures of the information entropy responsively to the respective SNRs.

7. The method according to claim 4, wherein selecting the second speech encoding scheme comprises averaging the measures of the information entropy, and selecting the second speech encoding scheme responsively to the averaged measures of the information entropy.

8. The method according to claim 7, wherein selecting the second speech encoding scheme comprises computing an equivalent Carrier to Interference (C/I) ratio responsively to the averaged measures of the information entropy, and selecting the second speech encoding scheme responsively to the equivalent C/I ratio.

9. The method according to claim 7, wherein selecting the second speech encoding scheme comprises computing an estimated Frame Error Rate (FER) responsively to the averaged measures of the information entropy, and selecting the second speech encoding scheme responsively to the estimate FER.

10. The method according to claim 1, wherein estimating the measure of the information entropy comprises estimating a Frame Error Rate (FER) of the received signals responsively to the measure of the information entropy, and wherein selecting the second speech encoding scheme comprises predefining a target FER value, and selecting the second speech encoding scheme such that the estimated FER of the received signals meets the target FER value.

11. A communication apparatus, comprising:

a transceiver, which is configured to receive modulated signals that convey encoded speech that is encoded using a first speech encoding scheme; and a processor, which is configured to estimate a measure of information entropy that quantifies an amount of information content in the encoded speech that is missed by not having a prior knowledge of transmitted values of the received signals, to select a second speech encoding scheme, different from the first speech encoding scheme, responsively to the estimated measure of the information entropy, and to send via the transceiver a request to a transmitter to encode subsequent speech using the selected second speech encoding scheme.

12. The apparatus according to claim 11, wherein the measure of the information entropy comprises a Mutual Information (MI) of the received signals.

13. The apparatus according to claim 11, wherein the measure of the information entropy comprises an Exponential Effective Signal to Interference and Noise Ratio Mapping (EESM) function, calculated over the received signals.

14. The apparatus according to claim 11, wherein the transceiver is configured to receive a sequence of modulated symbols that are divided into multiple groups, and wherein the processor is configured to estimate multiple measures of the information entropy over the respective groups.

15. The apparatus according to claim 14, wherein the transceiver is configured to receive the multiple groups of the symbols over respective, different time slots.

16. The apparatus according to claim 14, wherein the processor is configured to calculate Signal to Noise Ratios (SNRs) of the symbols in the respective groups, and to compute the measures of the information entropy responsively to the respective SNRs.

17. The apparatus according to claim 14, wherein the processor is configured to average the measures of the information entropy, and to select the second speech encoding scheme responsively to the averaged measures of the information entropy.

18. The apparatus according to claim 17, wherein the processor is configured to compute an equivalent Carrier to Interference (C/I) ratio responsively to the averaged measures of the information entropy, and to select the second speech encoding scheme responsively to the equivalent C/I ratio.

19. The apparatus according to claim 17, wherein the processor is configured to compute an estimated Frame Error Rate (FER) responsively to the averaged measures of the information entropy, and to select the second speech encoding scheme responsively to the estimate FER.

20. The apparatus according to claim 11, wherein the processor is configured to estimate a Frame Error Rate (FER) of the received signals responsively to the measure of the information entropy, and to select the second speech encoding scheme such that the estimated FER of the received signals meets a predefined target FER value.

21. A method for communication, comprising:

receiving modulated signals, which convey encoded speech that is encoded using a first speech encoding scheme;

estimating a measure of information entropy, which quantifies an amount of information content in the encoded speech that is missed by not having a prior knowledge of transmitted values of the received signals;

estimating a block error rate of the received signals responsively to the estimated measure of the information entropy;

selecting a second speech encoding scheme, different from the first speech encoding scheme, responsively to the estimated block error rate; and sending a request to a transmitter to encode subsequent speech using the selected second speech encoding scheme.

* * * * *